US012540546B2

(12) United States Patent
Naveena-Chandran et al.

(10) Patent No.: US 12,540,546 B2
(45) Date of Patent: Feb. 3, 2026

(54) IDENTIFYING ASPHALTENE PRECIPITATION AND AGGREGATION WITH A FORMATION TESTING AND SAMPLING TOOL

(71) Applicant: Halliburton Energy Services, Inc., Houston, TX (US)

(72) Inventors: Rohin Naveena-Chandran, Houston, TX (US); Syed Muhammad Farrukh Hamza, Houston, TX (US); Gibran Mushtaq Hashmi, Houston, TX (US); Jason A Rogers, Houston, TX (US); Christopher Michael Jones, Katy, TX (US); Anthony Herman VanZuilekom, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 154 days.

(21) Appl. No.: 18/410,321

(22) Filed: Jan. 11, 2024

(65) Prior Publication Data

US 2024/0151140 A1 May 9, 2024

Related U.S. Application Data

(63) Continuation of application No. 17/589,336, filed on Jan. 31, 2022, now Pat. No. 11,905,830.

(Continued)

(51) Int. Cl.

| | |
|---|---|
| ***E21B 49/08*** | (2006.01) |
| ***E21B 47/06*** | (2012.01) |
| ***E21B 49/10*** | (2006.01) |

(52) U.S. Cl.
CPC ..... *E21B 49/08* (2013.01); *E21B 47/06* (2013.01); *E21B 49/10* (2013.01)

(58) Field of Classification Search
CPC ..... E21B 49/08; E21B 47/06; E21B 49/10
See application file for complete search history.

(56) References Cited

U.S. PATENT DOCUMENTS

| | | |
|---|---|---|
| 9,568,459 B2 | 2/2017 | Sullivan et al. |
| 9,581,014 B2 | 2/2017 | Chen et al. |

(Continued)

FOREIGN PATENT DOCUMENTS

| | | |
|---|---|---|
| EP | 1629177 | 4/2007 |
| WO | 2014-133764 | 9/2014 |

OTHER PUBLICATIONS

Rohin Naveena-Chandran, et al., Enhancing the understanding of asphaltene precipitation: a novel approach under in-situ conditions, SPWLA 62nd Annual Logging Symposium, May 17-20, 2021.

(Continued)

*Primary Examiner* — Catherine Loikith
(74) *Attorney, Agent, or Firm* — John Wustenberg; C. Tumey Law Group PLLC

(57) ABSTRACT

In general, in one aspect, embodiments relate to a method, that includes lowering a downhole tool to a target depth of a wellbore, sampling reservoir fluid containing asphaltene at the target depth using the downhole tool, controlling a pressure of the sampled reservoir fluid while downhole to induce one or more phase transitions of the asphaltene, measuring the sampled reservoir fluid after inducing the one or more phase transitions, and identifying fluid composition of the reservoir fluid based on the measuring.

15 Claims, 6 Drawing Sheets

Related U.S. Application Data

(60) Provisional application No. 63/169,417, filed on Apr. 1, 2021.

(56) References Cited

U.S. PATENT DOCUMENTS

| | | | |
|---|---|---|---|
| 10,281,397 | B2 * | 5/2019 | Sieben ..... G01N 33/2823 |
| 2005/0194134 | A1 | 9/2005 | McGregor et al. |
| 2010/0154529 | A1 | 6/2010 | Terabayashi et al. |
| 2013/0188169 | A1 | 7/2013 | Harrison et al. |
| 2013/0311099 | A1 | 11/2013 | Eyuboglu et al. |
| 2014/0345860 | A1 | 11/2014 | Van Zuilekom et al. |
| 2015/0039230 | A1 | 2/2015 | Proett et al. |
| 2015/0114627 | A1 | 4/2015 | Tokyo et al. |
| 2017/0261640 | A1 | 9/2017 | Chen et al. |
| 2018/0051559 | A1 | 2/2018 | Westacott et al. |
| 2018/0371904 | A1 | 12/2018 | Van Zuilekom et al. |
| 2019/0017377 | A1 | 1/2019 | He et al. |
| 2019/0100995 | A1 | 4/2019 | He et al. |
| 2019/0128117 | A1 | 5/2019 | Dumont et al. |
| 2019/0153860 | A1 | 5/2019 | Khan et al. |
| 2019/0162066 | A1 | 5/2019 | Chen et al. |
| 2020/0041689 | A1 | 2/2020 | Kirkwood et al. |
| 2020/0240264 | A1 | 7/2020 | He et al. |
| 2020/0256189 | A1 | 8/2020 | Sullivan et al. |
| 2020/0284140 | A1 | 9/2020 | Jones et al. |
| 2020/0378250 | A1 | 12/2020 | Olapade et al. |
| 2020/0400017 | A1 | 12/2020 | Olapade et al. |
| 2020/0400858 | A1 | 12/2020 | Olapade et al. |
| 2021/0032986 | A1 | 2/2021 | Jones et al. |
| 2021/0047924 | A1 | 2/2021 | Kallehbasti et al. |
| 2021/0054737 | A1 | 2/2021 | Dai et al. |
| 2021/0088447 | A1 | 3/2021 | Stark et al. |
| 2021/0123313 | A1 | 4/2021 | Westacott et al. |
| 2021/0123344 | A1 | 4/2021 | Westacott et al. |
| 2021/0207478 | A1 | 7/2021 | Pelletier et al. |
| 2021/0215033 | A1 | 7/2021 | Jones et al. |
| 2021/0231001 | A1 | 7/2021 | Jones et al. |
| 2021/0238999 | A1 | 8/2021 | Naveena-Chandran et al. |
| 2021/0239000 | A1 | 8/2021 | Olapade et al. |
| 2021/0317738 | A1 | 10/2021 | Jones et al. |
| 2021/0332699 | A1 | 10/2021 | Dai et al. |

OTHER PUBLICATIONS

International Search Report and Written Opinion for Application No. PCT/US2022/016166, dated May 26, 2022.
Office Action Summary for U.S. Appl. No. 17/589,336 dated May 24, 2023.
Notice of Allowance for U.S. Appl. No. 17/589,336 dated Oct. 12, 2023.

* cited by examiner $P > P_{UAOP}$ $P = P_{UAOP}$
$P < P_{ARFO}$ $P = P_{ARFO}$
$P < P_{BP}$ $P = P_{BP}$
$P < P_{LAOP}$ $P_{BP} < P < P_{LOAP}$

IDENTIFYING ASPHALTENE PRECIPITATION AND AGGREGATION WITH A FORMATION TESTING AND SAMPLING TOOL

CROSS REFERENCE TO RELATED APPLICATIONS

This is a continuation application of U.S. patent application Ser. No. 17/589,336 filed Jan. 31, 2022, the entirety of which is incorporated herein by reference in its entirety. This application also claims priority to U.S. Provisional Patent Application No. 63/169,417 filed Apr. 1, 2021, the entirety of which is also incorporated herein by reference in its entirety.

BACKGROUND

Wells may be drilled at various depths to access and produce oil, gas, minerals, and other naturally occurring deposits from subterranean geological formations. The drilling of a well is typically accomplished with a drill bit that is rotated within the well to advance the well by removing topsoil, sand, clay, limestone, calcites, dolomites, or other materials.

During or after drilling operations, sampling operations may be performed to collect a representative sample of formation or reservoir fluids (e.g., hydrocarbons) to further evaluate drilling operations and production potential, or to detect the presence of certain gases or other materials in the formation that may affect well performance.

The ability to reservoir fluid to flow freely to the surface is a constant challenge that affects the viability of an asset in all oil producing wellbore. The prevailing issue in the industry is asphaltenes. Asphaltenes are found in reservoir fluids and may fall out of solution due to a change in temperature or pressure as the reservoir fluid ascends to the surface. A proper understanding of asphaltene deposition lends itself to reliable completions planning, and timely remediation efforts. This ultimately dictates the production life of the reservoir.

Traditionally, this measurement has been determined post acquisition through different laboratory techniques performed on a reservoir fluid sample. However, samples of reservoir fluids need to be restored to reservoir conditions in order to determine when asphaltenes may fall out of solution. This is complicated due to other requirements, such as maintaining reservoir fluid samples at equilibrium composition and the destruction of reservoir fluid samples through inadvertent asphaltene precipitation during transporting and handling.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates to subterranean operations and, more particularly, embodiments disclosed herein provide methods and systems for capture of reservoir fluids and measurement of asphaltenes within the reservoir fluids in-situ. Specifically, methods and systems perform fluid sample operations in which a reservoir fluid is taken from a reservoir in a formation. The reservoir fluid is isothermally depressurized from initial reservoir pressure. Simultaneously, a fluid sampling tool monitors asphaltene precipitation from solution and a pressure gauge records the onset of asphaltene precipitation. Measurements may be provided continuously and in real-time. An added advantage is that experiments are performed individually after obtaining a pressurized sample in distinct oil zones. Therefore, the execution of these downhole measurements is performed independent of an already captured reservoir fluid sample and does not impact the quality of any later laboratory-based analysis.

The fluid sampling tools, systems and methods described herein may be used with any of the various techniques employed for evaluating a well, including without limitation wireline formation testing (WFT), measurement while drilling (MWD), and logging while drilling (LWD). The various tools and sampling units described herein may be delivered downhole as part of a wireline-delivered downhole assembly or as a part of a drill string. It should also be apparent that given the benefit of this disclosure, the apparatuses and methods described herein have applications in downhole operations other than drilling and may also be used after a well is completed.

Figure 1A:
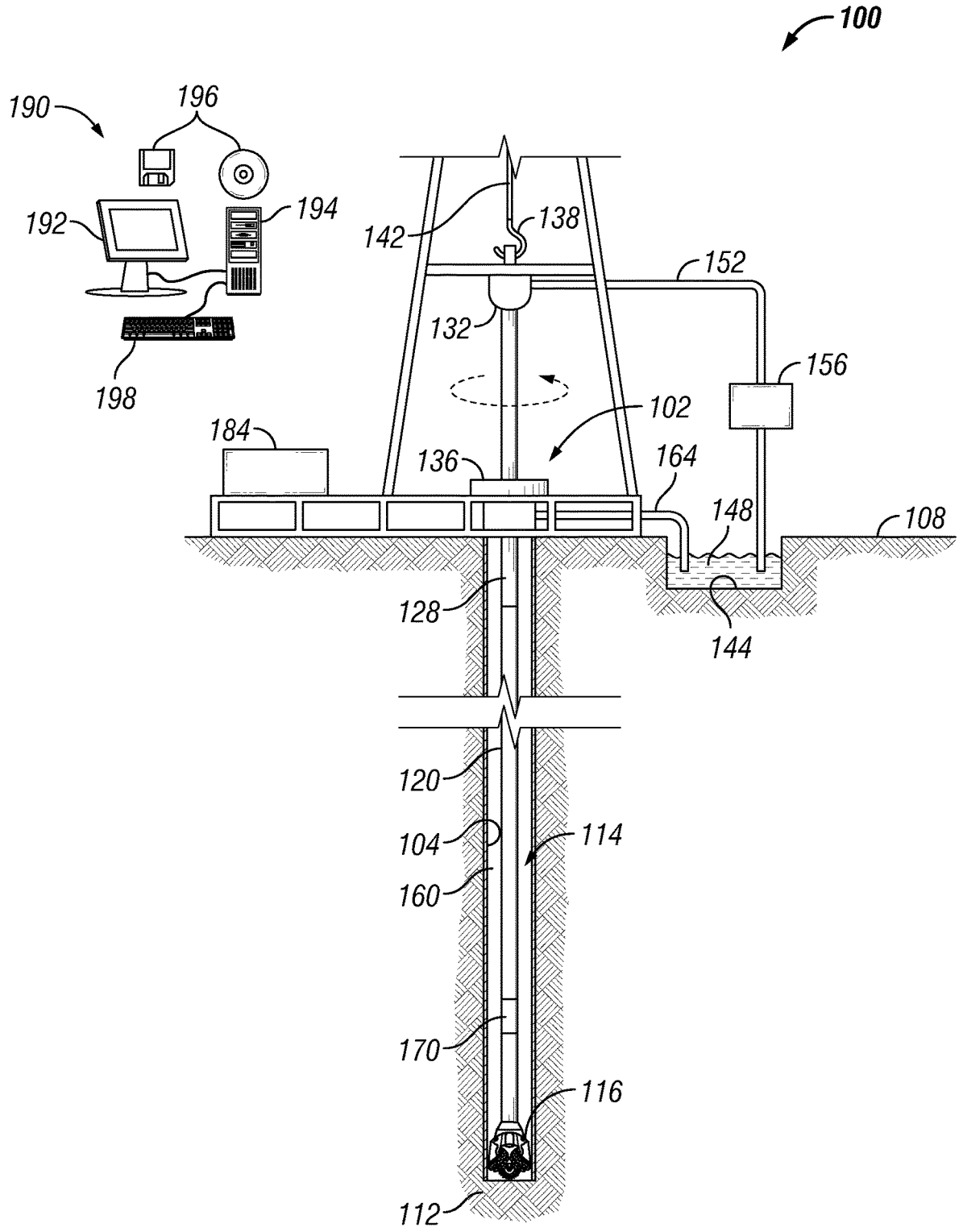
FIG. 1A illustrates a schematic view of a well in which an example embodiment of a fluid sample system is deployed.

FIG. 1A illustrates a fluid sampling and analysis system 100 according to an illustrative embodiment used in a well 102 having a wellbore 104 that extends from a surface 108 of well 102 to or through a subterranean formation 112. While wellbore 104 is shown extending generally vertically into subterranean formation 112, the principles described herein are also applicable to wellbores that extend at an angle through subterranean formations 112, such as horizontal and slanted wellbores. For example, although FIG. 1A shows wellbore 104 that is vertical or low inclination, high inclination angle or horizontal placement of wellbore 104 and equipment is also possible. In addition, it should be noted that while FIG. 1A generally depicts a land-based operation, those skilled in the art should readily recognize that the principles described herein are equally applicable to subsea operations that employ floating or sea-based platforms and rigs, without departing from the scope of the disclosure.

Well 102 is illustrated with fluid sampling and analysis system 100 being deployed in a drilling assembly 114. In the embodiment illustrated in FIG. 1A, well 102 is formed by a drilling process in which a drill bit 116 is turned by a drill string 120 that extends from drill bit 116 to surface 108 of well 102. Drill string 120 may be made up of one or more connected tubes or pipes of varying or similar cross-section. Drill string 120 may refer to the collection of pipes or tubes as a single component, or alternatively to the individual pipes or tubes that include the string. The term "drill string" is not meant to be limiting in nature and may refer to any component or components that are capable of transferring rotational energy from the surface of the well to the drill bit. In several embodiments, drill string 120 may include a central passage disposed longitudinally in drill string 120 and capable of allowing fluid communication between surface 108 of well 102 and downhole locations.

At or near surface 108 of well 102, drill string 120 may include or be coupled to a kelly 128. Kelly 128 may have a square, hexagonal, octagonal, or other suitable cross-section. In examples, kelly 128 may be connected at one end to the remainder of drill string 120 and at an opposite end to a rotary swivel 132. As illustrated, kelly 120 may pass through a rotary table 136 that is capable of rotating kelly 128 and thus the remainder of drill string 120 and drill bit 116. Rotary swivel 132 should allow kelly 128 to rotate without rotational motion being imparted to rotary swivel 132. A hook 138, cable 142, traveling block (not shown), and hoist (not shown) may be provided to lift or lower the drill bit 116, drill string 120, kelly 128 and rotary swivel 132. Kelly 128 and swivel 132 may be raised or lowered as needed to add additional sections of tubing to drill string 120 as drill bit 116 advances, or to remove sections of tubing from drill string 120 if removal of drill string 120 and drill bit 116 from well 102 is desired.

A reservoir 144 may be positioned at surface 108 and holds drilling fluid 148 for delivery to well 102 during drilling operations. A supply line 152 may fluidly couple reservoir 144 and the inner passage of drill string 120. A pump 156 may drive drilling fluid 148 through supply line 152 and downhole to lubricate drill bit 116 during drilling and to carry cuttings from the drilling process back to surface 108. After traveling downhole, drilling fluid 148 returns to surface 108 by way of an annulus 160 formed between drill string 120 and wellbore 104. At surface 108, drilling mud 148 may returned to reservoir 144 through a return line 164. Drilling mud 148 may be filtered or otherwise processed prior to recirculation through well 102.

Figure 1B:
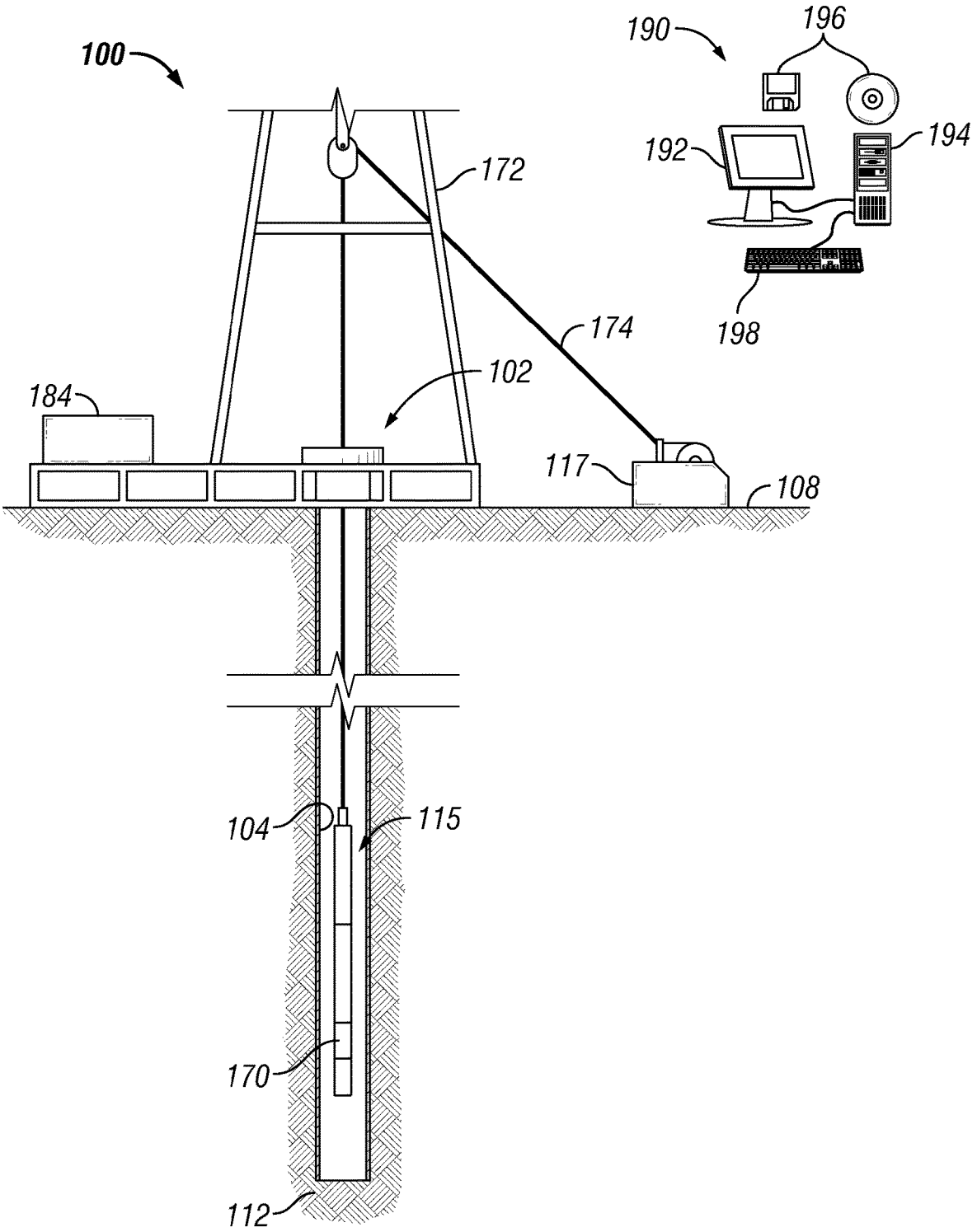
FIG. 1B illustrates a schematic view of another well in which an example embodiment of a fluid sample system is deployed.

FIG. 1B illustrates a schematic view of another embodiment of well 102 in which an example embodiment of fluid analysis system 100 may be deployed. As illustrated, fluid analysis system 100 may be deployed as part of a wireline assembly 115, either onshore or offshore. As illustrated, wireline assembly 115 may include a winch 117, for example, to raise and lower a downhole portion of wireline assembly 115 into well 102. As illustrated, fluid analysis system 100 may include fluid sampling tool 170 attached to winch 117. In examples, it should be noted that fluid sampling tool 170 may not be attached to winch 117. Fluid sampling tool 170 may be supported by rig 172 at surface 108.

Fluid sampling tool 170 may be tethered to winch 117 through wireline 174. While FIG. 1B illustrates wireline 174, it should be understood that other suitable conveyances may also be used for providing mechanical conveyance to fluid sampling tool in well 102, including, but not limited to, slickline, coiled tubing, pipe, drill pipe, drill string, downhole tractor, or the like. In some examples, the conveyance may provide mechanical suspension, as well as electrical connectivity, for fluid sampling tool 170. Wireline 174 may include, in some instances, a plurality of electrical conductors extending from winch 117. By way of example, wireline 174 may include an inner core of seven electrical conductors (not shown) covered by an insulating wrap. An inner and outer steel armor sheath may be wrapped in a helix in opposite directions around the conductors. The electrical conductors may be used for communicating power and telemetry downhole to fluid sampling tool 170.

With reference to both FIGS. 1A and 1B, operation of fluid sampling tool 170 for sample collection will now be described in accordance with example embodiments. Fluid sampling tool 170 may be raised and lowered into well 102 on drill string 120 (e.g., referring to FIG. 1A) and wireline 174 (e.g., referring to FIG. 1B). Fluid sampling tool 170 may be positioned downhole at a zone of interest to obtain reservoir fluid samples (which may also be referred to as reservoir fluids) from the subterranean formation 112 for analysis. After analysis fluid sampling tool 170 may move to other zones of interest within wellbore 104. The reservoir fluid and, thus the reservoir fluid sample may be contaminated with, or otherwise contain, the target component. In some embodiments, the target component may be contained in the reservoir fluid sample in small quantities, for example, less than 500 parts per million ("ppm"). Additionally, the target component may be present in the reservoir fluid sample in an amount from about 1 ppm to about 500 ppm, about 100 ppm to about 200 ppm, about 1 ppm to about 100 ppm, or about 5 to about 10 ppm. Fluid sampling tool 170 may be operable to measure, process, and communicate data regarding subterranean formation 112, reservoir fluid from subterranean formation 112, or other operations occurring downhole. After recovery, the reservoir fluid sample may be analyzed, for example, to quantify the concentration of the target component. This information, including information gathered from analysis of the reservoir fluid sample, allows well operators to determine, among other things, the concentration the target component within the reservoir fluid being extracted from subterranean formation 112 to make intelligent decisions about ongoing operation of well 102. In some embodiments, the data measured and collected by fluid sampling tool 170 may include, without limitation, pressure, temperature, flow, acceleration (seismic and acoustic), and strain data. As described in more detail below, fluid sampling tool 170 may include a communications subsystem, including a transceiver for communicating using mud pulse telemetry or another suitable method of wired or wireless communication with a surface controller 184. The transceiver may transmit data gathered by fluid sampling tool 170 or receive instructions from a well operator via surface controller 184 to operate fluid sampling tool 170.

Figure 2:
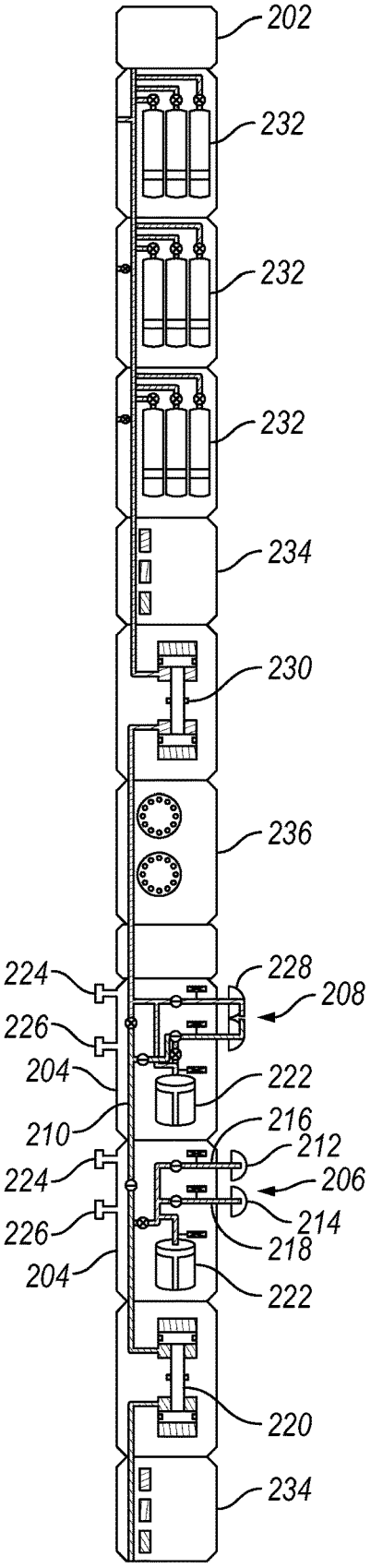
FIG. 2 illustrates a schematic view of an example embodiment of a Fluid sampling tool.

FIG. 2 illustrates a schematic of fluid sampling tool 170. As illustrated, fluid sampling tool 170 includes a power telemetry section 202 through which fluid sampling tool 170 may communicate with other actuators and sensors in a conveyance (e.g., drill string 120 on FIG. 1A or wireline 174 on FIG. 1B), the conveyance's communications system, and with a surface controller (surface controller 184 on FIG. 1A). In examples, power telemetry section 202 may also be a port through which the various actuators (e.g., valves) and sensors (e.g., temperature and pressure sensors) in fluid sampling tool 170 may be controlled and monitored. In examples, power telemetry section 202 includes an information handling system that exercises the control and monitoring function. In one example, the control and monitoring function is performed by an information handling system in another part of the drill string or wireline tool (not shown) or by an information handling system at surface 108 (e.g., referring to FIG. 1A or 1B).

Information from fluid sampling tool 170 may be gathered and/or processed by the information handling system. The processing may be performed real-time during data acquisition or after recovery of fluid sampling tool 170. Processing may alternatively occur downhole or may occur both downhole and at surface. In some examples, signals recorded by fluid sampling tool 170 may be conducted to information handling system by way of conveyance. Information handling system may process the signals, and the information contained therein may be displayed for an operator to observe and stored for future processing and reference. Information handling system may also contain an apparatus for supplying control signals and power to fluid sampling tool 170.

Systems and methods of the present disclosure may be implemented, at least in part, with information handling system 190. Alternatively, information handling system 190 may be a component of fluid sampling tool 170. An information handling system 190 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 190 may be a personal computer, a network storage device, or any other suitable device and may vary in size, shape, performance, functionality, and price. Information handling system 190 may include a processing unit 194 (e.g., microprocessor, central processing unit, etc.) that may process EM log data by executing software or instructions obtained from a local non-transitory computer readable media 196 (e.g., optical disks, magnetic disks). The non-transitory computer readable media 196 may store software or instructions of the methods described herein. Non-transitory computer readable media 196 may include any instrumentality or aggregation of instrumentalities that may retain data and/or instructions for a period of time. Non-transitory computer readable media 196 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing. Information handling system 190 may also include input device(s) 198 (e.g., keyboard, mouse, touchpad, etc.) and output device(s) 192 (e.g., monitor, printer, etc.). The input device(s) 198 and output device(s) 192 provide a user interface that enables an operator to interact with fluid sampling tool 170 and/or software executed by processing unit 194. For example, information handling system 190 may enable an operator to select analysis options, view collected log data, view analysis results, and/or perform other tasks In examples, fluid sampling tool 170 may include one or more probe sections 204. Each probe section may include a dual probe section 206 or a focus sampling probe section 208. Both of which may extract reservoir fluid from the reservoir and delivers it to a channel 210 that extends from one end of fluid sampling tool 170 to the other. Without limitation, dual probe section 206 includes two probes 212, 214 which may extend from fluid sampling tool 170 and press against the inner wall of wellbore 104 (e.g., referring to FIG. 1). Probe channels 216, 218 may connect probes 212, 214 to channel 210. A high-volume bidirectional pump 220 may be used to pump reservoir fluids from the reservoir, through probe channels 216, 218 and to channel 210. Alternatively, a bidirectional piston pump 222 may be used to remove reservoir fluid from the reservoir and house them for asphaltene measurements, discussed below. Two standoffs or stabilizers 224, 226 hold fluid sampling tool 170 in place as probes 212, 214 press against the wall of wellbore 104. In examples, probes 212, 214 and stabilizers 224, 226 may be retracted when fluid sampling tool 170 may be in motion and probes 212, 214 and stabilizers 224, 226 may be extended to sample the reservoir fluids at any suitable location in wellbore 104. As illustrated, probes 212, 214 may be replaced, or used in conjunction with, focus sampling probe section 208. Focus sampling probe section 208 may operate and function as discussed above for probes 212, 214 but with a single probe 228. Other probe examples may include, but are not limited to, oval probes, or packers.

In examples, channel 210 may connect other parts and sections of fluid sampling tool 170 to each other. For example, Additionally, formation sampling tool 170 may include a second high-volume bidirectional pump 230 for pumping reservoir fluid through channel 210 to one or more multi-chamber sections 232, one or more amide side fluid density modules 234, and/or one or more optical measurement tools 238 in fluid analysis module 236.

Figure 3:
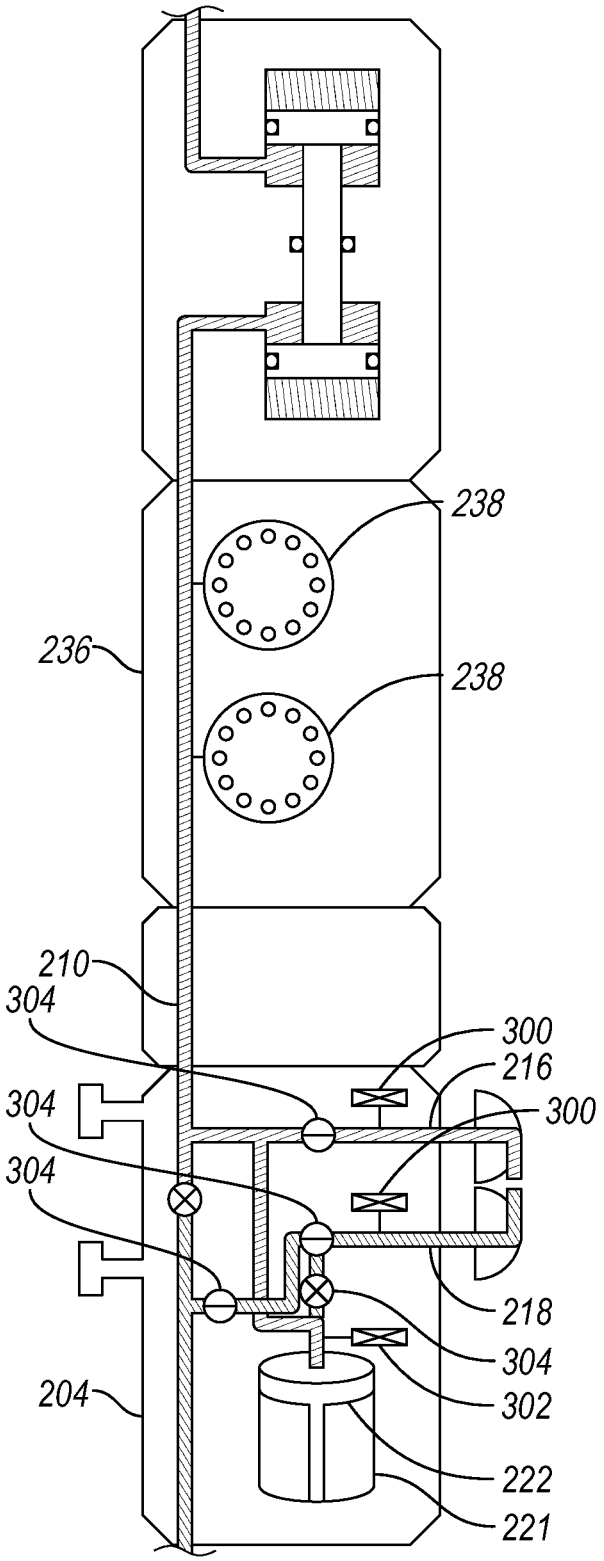
FIG. 3 illustrates an enlarged schematic view of a probe section.

FIG. 3 illustrates an expanded view of a probe section 204. As illustrated, probe section 204 includes bidirectional piston pump 222, which is utilized for asphaltene measurements. Asphaltenes are large, high-density hydrocarbons that may be the heaviest component in reservoir fluids. The precipitation and deposition of asphaltenes are a nuisance to any petroleum production system since that may lead to reduction in productivity or injectivity of a well. Asphaltene precipitation and ultimate deposition is caused by a number of factors including changes in pressure, temperature, and composition.

As the reservoir inside formation undergoes primary depletion, the pore (also called reservoir pressure) pressure as well as the flowing bottomhole pressure drops. For a constant temperature, as the decreasing pressure in the reservoir and the wellbore 104 (e.g., referring to FIG. 1) reaches the asphaltene precipitation onset pressure, the dissolved asphaltenes start to precipitate and deposit. This deposition may take place in the reservoir, or near/at the sandface, or in wellbore 104, or in the tubing, or at the surface facilities. This blockage of production paths causes further pressure drops, which results in higher asphaltene precipitation. Over time, this deposition becomes worse until the bubble point pressure is reached. As the pressure falls further below, the asphaltene begins to redissolve into the liquid phase. The deposition of asphaltene may also be caused by changes in reservoir fluid composition, and temperature, as well as the introduction of any incompatible chemicals. Identifying when asphaltene falls out of solution is currently performed by laboratory test. To do this, a reservoir fluid sample is taken by fluid sampling tool 170 and extracted at the surface. From there the reservoir fluid sample is sent to a laboratory for analyses.

Analyses of asphaltenes may be performed with any number of scientific evaluations. A few a listed here for reference. One such operation is the Colloidal Instability Index (CII) that was created to illustrate a scale of eventual asphaltene deposition during production. The CII is made up of Saturates, Aromatics, Resins and Asphaltenes (SARA) fractional components and described by the following equation:

$$CII = \frac{\text{Saturates } \% + \text{Asphaltenes } \%}{\text{Aromatics } \% + \text{Resins } \%} \quad (1)$$

The index is governed by the following criteria:

CII≤0.7: asphaltene fraction stable $0.7 \leq CII \leq 0.9$: asphaltene fraction uncertain $CII \geq 0.9$: asphaltene fraction unstable The CII may be utilized with methods below to show pressure indicating stability and instability before and after Asphaltene Onset Pressure (AOP).

Another scientific method to analyze asphaltenes is using a refractive index. A Refractive Index (RI) describes the amount of light bending through a medium. RI is proven to accurately describe reservoir fluid properties of a hydrocarbon which may be then applied towards reservoir calculations. The refractive index of oil with respect to a SARA fraction by the following equation:

$$RI_{oil}=0.01452\times(\text{Saturates }\%)+0.0014982\times(\text{Asphaltenes }\%)+0.0016624\times(\text{Resins }\%+\text{Asphaltenes }\%) \quad (2)$$

At the point of AOP, the RI is described as the Precipitation Refractive Index (PRI). The relation between PRI and $RI_{oil}$ describe a measure that dictates asphaltene stability by the following equation:

$$\lambda(RI)=RI_{oil}\times PRI \quad (3)$$

The index is governed by the following criteria:

$\Delta(RI) \leq 0.045$: asphaltene unstable $0.045 \leq \Delta(RI) \leq 0.060$: asphaltene bordering stability $\Delta(RI) \geq 0.060$: asphaltene stable To describe the solvency of asphaltenes within an oil mixture, the solubility parameter $\delta$ is a measurement that accounts for molecular forces and energy density of asphaltenes relative to a solution. The Equations below show a relation that describes the solubility parameter of an oil mixture using the oil mixture's refractive index:

$$\delta = 52.042F_{RI} + 2.904 \quad (4)$$

$$F_{RI} = \frac{(RI^2 - 1)}{(RI^2 + 2)} \quad (5)$$

Where RI is the refractive index of the oil component.

At higher temperatures less amount of asphaltene is precipitated. A corollary effect is that the oil is more soluble and stable for asphaltenes. As such, a parameter defined as the "driving force" is established to dictate the force micro-aggregate asphaltenes have over asphaltenes in solution, which is the difference in solubilities as shown in equation:

$$\Delta\delta=\delta_{asph}-\delta_{solution} \quad (6)$$

Another scientific model may be used to find the rate of precipitation for asphaltene. It is assumed proportional to the supersaturation degree of asphaltenes that is defined as the difference between the actual concentration of asphaltenes dissolved in oil and the concentration of asphaltene at equilibrium for a specific temperature and pressure. This rate of precipitation may be described mathematically as:

$$\frac{dC}{dt} = k_p(C_A - C_A^{eq}) \quad (7)$$

where $\frac{dC}{dt}$ is the rate at which the concentration of asphaltene precipitate changes (i.e., the rate at which dissolved asphaltenes precipitate forming micro-aggregates), $k_p$ is the precipitation kinetic parameter, $C_A$ is the actual dissolved concentration of asphaltenes in solution at given operating conditions, and $C_A^{eq}$ is the concentration of asphaltenes in solution at equilibrium for the given temperature and pressure.

As evidenced from Equation 7 above, the precipitation process is modeled as a first order reaction based on the degree of supersaturation of asphaltenes. The higher the concentration difference between the dissolved and equilibrium concentration, the higher the precipitation rate becomes. This concentration difference or the degree of supersaturation in the context of precipitation starts at 0 which is right at the precipitation onset. With decreasing pressure, the equilibrium concentration at the operating conditions goes down as well and therefore the supersaturation degree increases leading to an increase in the rate of precipitation. Gradually, as the dissolved concentration goes down, the rate of precipitation stabilizes before going down again. Since the dissolved concentration of asphaltenes at every point is not known in the system, the differential equation above can be solved to come up with an expression for the rate of precipitation as:

$$\frac{dC}{dt} = k_p(C_0 - C_A^{eq})e^{k}p^{\Delta t} \quad (8)$$

where $C_0$ is the concentration of dissolved asphaltenes right before the precipitation onset and $\Delta t$ is the incremental time from that point onwards. Equation 8 may then be used to model the rate of precipitation of asphaltene in a reservoir section once the tuning parameter ($k_p$) is sufficiently known.

Experiments and modeling showed that $k_p$ is lower for higher temperatures as well. Therefore, the following relation was derived to relate the kinetic factor, temperature and driving force:

$$k_p = \exp\left(a_0\exp\left(\frac{-a_1}{T}\right) - \frac{b_0\exp\left(\frac{-b_1}{T}\right)}{\Delta\delta}\right) \quad (9)$$

where $a_0$, $b_0$, $a_1$, $b_1$ are constants based on reservoir fluid dynamics of asphaltene deposition. From this, the following independent correlations may be observed:

$$k_p \propto \frac{1}{T},\ k_p \propto \frac{1}{\Delta\delta},\ \text{and}\ \Delta\delta_p \propto \frac{1}{T} \quad (10)$$

As discussed below, a gravimetric method may have a similar effect by destabilizing asphaltenes over time with an increased pressure differential AP' from soluble to precipitate. More specifically:

$$\Delta P'=P_{asph}-P_{solution} \quad (11)$$

where $P_{asph}$ are where asphaltene concentrations increase due to precipitation, and $P_{solution}$ is the baseline pressure at which asphaltenes are in solution.

As illustrated in FIG. 3, these laboratory test may be reconstructed downhole using probe section 204. Specifically, testing methods include the use of housing 221 that includes a bidirectional piston pump 222 within probe section 204. Housing 221 allows for bidirectional piston pump 222 to draw in reservoir fluid for measurement, analyses, or testing within the housing. When sampling operations are being performed, as described above, reservoir fluid is extracted from a reservoir through a probe, such as focus sampling probe section 208, and into fluid sampling tool 170 through probe channels 216 and 218. Reservoir fluid is pulled from the formation, through the probe, and to housing 221 at least in part by bidirectional piston pump 222. Bidirectional piston may create a vacuum that draws reservoir fluid into housing 221. As illustrated, probe channels 216 and 218 may each be connected to independent zero offset quartz pressure gauges 300. Fluid sampling tool 170 includes housing 221 and bidirectional piston pump 222, where housing 221 may have 100 cc of capacity and the capability to operate up to 20000 psi below hydrostatic pressure, which is monitored by another pressure gauge 302.

During measurement operations, the onset of asphaltenes may be measured utilizing probe section 204 and/or fluid analysis module 236. Within fluid analysis module 236 may be one or more optical measurement tools 238 that are fluidly connected to channel 210. As testing methods are performed with housing 221, additional testing methods may analyze reservoir fluid in channel 210 with one or more optical measurement tools 238 in fluid analysis module 236.

Additionally, probe channels 216 and 218 have the ability to be isolate from internal flowlines, such as channel 210, from the formation through one or more shut in valves 304 positioned along each probe channels 216 and 218. This allows probe section 204 to access reservoir fluids from either only in fluid sampling tool 170 or reservoir fluid taken through a probe.

Figure 6:
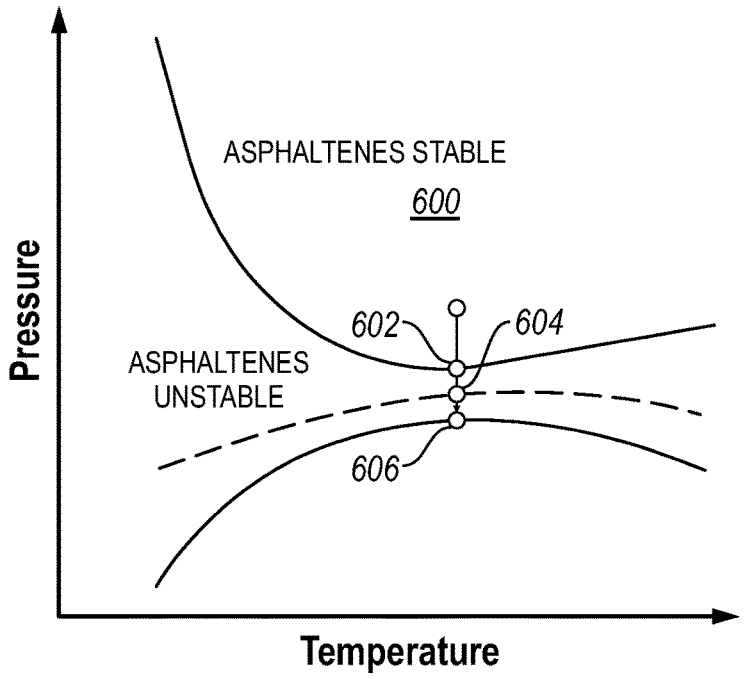
FIG. 6 is a graph illustrating asphaltene phase envelope denoting the stability regions of asphaltenes during production

FIG. 6 is a graph illustrating asphaltene phase envelope denoting the stability regions of asphaltenes during production. As illustrated, Upper Asphaltene boundary 600 separates asphaltenes in equilibrium denoted "Asphaltene Stable". As a reservoir starts producing (Flowing Pressure) at the sandface, the reservoir eventually depletes and asphaltenes start precipitating at the Upper Asphaltene Onset Pressure (UAOP) 602, where the reservoir fluid becomes thermodynamically unstable. As pressure crosses the bubble point (BP) 604, gas evolves from solution and is also near where the peak of asphaltene precipitation exists. The Lower Asphaltene Onset Pressure (LAOP) 606 is the lowest pressure where asphaltenes are out of solution. As the pressure falls further below, the asphaltene begins to redissolve into the liquid and gas phases. This transition is represented with a corresponding increase in asphaltene precipitate from UAOP 602 to the peak at BP 604 and then lowest at the LAOP 606.

Asphaltenes undergo a series of kinetic phases when destabilizing On Precipitation, asphaltene molecules initially evolve out of solution at the UAOP 602, and they reside as visibly suspended particles. With an increase in precipitation, molecules eventually aggregate and combine in the Flocculation process. If flocculated particles are noticed (or predicted) early enough, they may be easily remediated during production, which will lead to a de-aggregation of flocculated particles is known as Disassociation. However, if flocculation is left without action, they will lead to Deposition. This stage is a considerable threat, where asphaltenes reduce reservoir efficiency by plugging pores in the sandface, depositing on tubing walls. The consequence of not detecting the UAOP 602 early enough may lead to catastrophic consequences and require considerable costly remediation efforts.

Figure 4A:
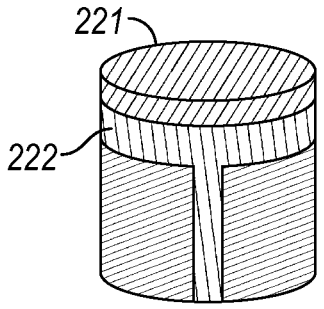
FIGS. 4A-4E illustrate stages of measuring asphaltene precipitation.

FIGS. 4A-4E illustrate operation of bidirectional piston pump 222 allows for the measurement and analysis of asphaltenes from reservoir fluid to determine UAOP 602, BP 604, and/or LAOP 606 (e.g., referring to FIG. 6). Referring to FIG. 4A, to begin measurement operations to analyze asphaltenes at a determined location within wellbore 104 (e.g., referring to FIG. 1), probe section 204 is activated to allow fluid sampling tool 170 to be in fluid communication with a formation through dual probe section 206 or focus sampling probe section 208, as described above. After establishing a formation pressure, and optionally taking samples, a gravimetric test is performed.

Measurements taken by zero offset pressure gauges 300 and pressure gauge 302 may be utilized to perform a gravimetric test on an information handling system 190 (e.g., referring to FIG. 1) to determine asphaltene precipitation. To perform the gravimetric test, probe channels 216 and 218 (e.g., referring to FIG. 3) may be in fluid communication with the reservoir in the formation. Additionally, it should be noted, that the one or more shut in valves 304 (e.g., referring to FIG. 3) have been activated to isolate bidirectional piston pump 222 and housing 221 (e.g., referring to FIG. 3) from other components and devices in fluid sampling tool 170 (e.g., referring to FIG. 3). Using zero offset pressure gauges 300 and pressure gauge 302 (e.g., referring to FIG. 3), flowing pressure and temperature of the reservoir fluid at a sample point in wellbore 104 are measured. Additionally, soluble fluid composition is measured by one or more optical measurement tools 238 in fluid analysis module 236 (e.g., referring to FIG. 3). The one or more optical measurement tools 238 may measure soluble reservoir fluid composition. Optical measurement tools 238 may measure soluble reservoir fluid composition by direct optical computing of the full wavelength to create a unique fingerprint of the fluid, including differentiation of SARA fractions, discussed above.

Figure 4B:
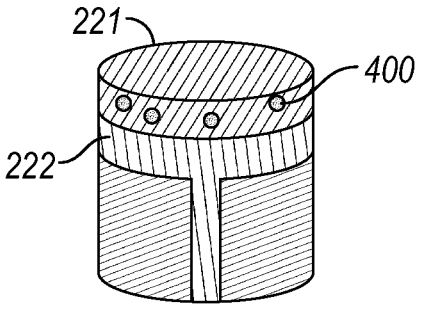
Figure 4C:
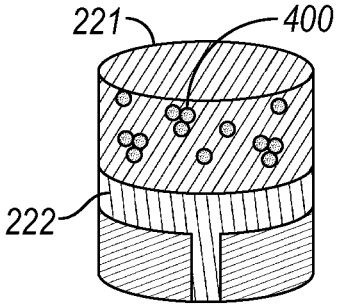
Figure 4D:
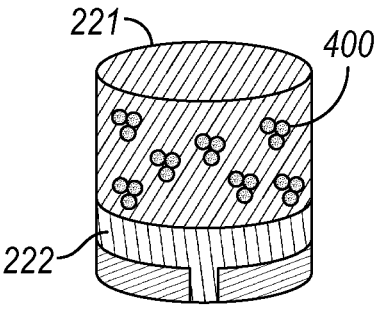
Figure 4E:
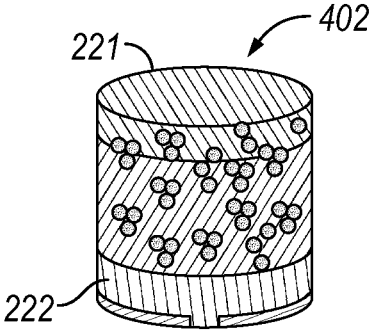

In FIG. 4A, bidirectional piston pump 222 (e.g., referring to FIG. 3) is drawn down at a preprogrammed constant rate, while reservoir fluid is drawn into housing 221 (e.g., referring to FIG. 3) by bidirectional piston pump 222 and is monitored in real time. As bidirectional piston pump 222 continues depressurization within housing 221, as illustrated in FIG. 4B, asphaltene particles 400 start precipitating at the Upper Asphaltene Onset Pressure (UAOP) point within housing 221. It should be noted that this effect is also applied to and seen in channel 210 (e.g., referring to FIG. 3), which is connected to housing 221. As this effect is seen in channel 210, this may allow one or more optical measurement tools 238 (e.g., referring to FIG. 3) to identify asphaltenes, asphaltene concentration, and/or the like within the reservoir fluid taken from the formation. The respective pressure and asphaltene concentration are detected by one or more zero offset pressure gauges 300 (e.g., referring to FIG. 3) and/or one or more pressure gauges 302 (e.g., referring to FIG. 3). In other embodiments, other components may be measured similar to asphaltene particles 400, such as, Saturates, Aromatics, Resins, and/or C1-C5%. In FIG. 4C, the illustrated asphaltene concentration 400 as it reaches the Asphaltene+ Resin-Flocculation Onset (ARFO). This is seen as precipitated asphaltene particles 400 begin to aggregate and start flocculating within the flowline with an inflection in the asphaltene weight percentage. As noted above, this inflection is detected by one or more optical measurement tools 238, which is also identifying and measuring this inflection in channel 210 that is connected to housing 221. In FIG. 4D, the bubble point (BP) is reached, which is shown in all sensor data that is measuring and analyzing asphaltene particles 400 within housing 221. In addition, further aggregation of asphaltene particles 400 occurs as part of flocculation. Lastly, in FIG. 4E, as the system crosses BP, lighter components 402 liberate from the system and there is a higher concentration of aggregated flocculates of asphaltene particles 400 in the flowline. At this stage the test is concluded by design and should be considered in the planning process.

It should be noted that measurements may be taken within housing 221. However, in other examples, measurements may be taken within one or more channels 210, and/or probe channels 216, 218. This is possible because the reservoir fluid within channels 210 and/or probe channels 216,218 may also undergo the gravimetric test, as they are connected to housing 221. Still further, housing 221 may be removed and the gravimetric test may be performed with a bidirectional piston pump 222 disposed within one or more channels 210 and/or probe channels 216, 218.

The gravimetric test is not intended to further depressurize the system to the Lower Asphaltene Onset Pressure (LAOP) point. During this progression, flocculation of asphaltene particles 400 may transition to deposition, and fluid sampling tool 170 is at risk being plugged and would be inoperable. As a result, no further sampling or pressure tests may be performed, and fluid sampling tool 170 would have to be pulled out to surface. Thus, the downhole operations (i.e., sampling operations) may allow for the detection and determination of the UAOP, ARFO and BP pressures.

Following the Gravimetric test, bidirectional piston pump 222 is then moved back to the original position within housing 221, compressing probe channels 216, 218 back to the reservoir flowing pressure. Subsequently, the shut-in valves 304 are opened, equalizing fluid sampling tool 170, and fluid sampling tool 170 may be retracted and moved to another location within wellbore 104 (e.g., referring to FIG. 1) for further sample or test operations. Additionally, fluid sampling tool 170 may also be removed to the surface. The above sequences are repeated at every sample point, providing APO, UAOP, AOP, ARFO and BP measurements at unique depths within the reservoir independent of the captured reservoir fluid sample.

Figure 5:
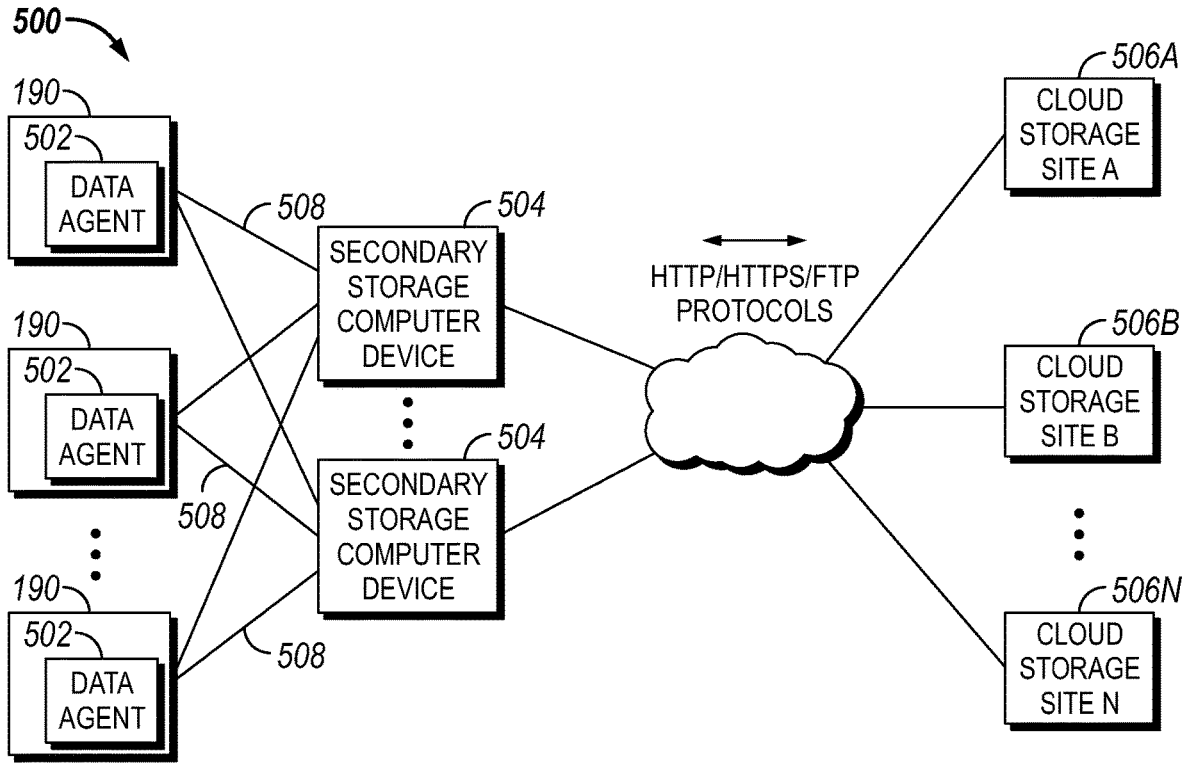
FIG. 5 illustrates a workflow for data communication.

FIG. 5 illustrates an example of one arrangement of resources in a computing network 500 that may employ the processes and techniques described herein, although many others are of course possible. Computing network 500 may be utilized to the execution of real time access to downhole operations involving multiple parties. For example, a typical downhole operation may involve both satellite transfer of data and visual access to fluid sampling tool 170. To perform this task, a plurality of information handling systems 190 may be utilized across a network. As noted above, an information handling system 190, as part of their function, may utilize data, which includes files, directories, metadata (e.g., access control list (ACLS) creation/edit dates associated with the data, etc.), and other data objects.

Although not illustrated, each information handling system 190 may be disposed at a rig site (See FIGS. 1A and 1B), with direct communication to fluid sampling tool 170, a client, a monitoring team communicating with a Field Engineer, and/or a team of specialists. All of whom may be separated by large distances. Each entity may monitor data from fluid sampling tool 170 and relay the results to any of the entities describe above in real time. This may ensure at operates performed downhole with fluid sampling tool 170 may produce reliable data and mitigate risk associated with the downhole operation.

The data communicated to and from information handling system 190 is typically a primary copy (e.g., a production copy). During a copy, backup, archive or other storage operation, information handling system 190 may send a copy of some data objects (or some components thereof) to a secondary storage computing device 504 by utilizing one or more data agents 502.

A data agent 502 may be a desktop application, website application, or any software-based application that is nm on information handling system 190. As illustrated, information handling system 190 may be disposed at any rig site (e.g., referring to FIG. 1), off site location, repair and manufacturing center, and/or the like. The data agent may communicate with a secondary storage computing device 504 using communication protocol 508 in a wired or wireless system.

Communication protocol 508 may function and operate as an input to a website application. In the website application, field data related to pre- and post-operations, and/or the like may be uploaded. Additionally, information handling system 190 may utilize communication protocol 508 to access processed measurements, operations with similar DTCs, troubleshooting findings, historical run data, and/or the like. This information is accessed from secondary storage computing device 504 by data agent 502, which is loaded on information handling system 190.

Secondary storage computing device 504 may operate and function to create secondary copies of primary data objects (or some components thereof) in various cloud storage sites 506A-N. Additionally, secondary storage computing device 504 may run determinative algorithms on data uploaded from one or more information handling systems 190, discussed further below. Communications between the secondary storage computing devices 504 and cloud storage sites 506A-N may utilize REST protocols (Representational state transfer interfaces) that satisfy basic C/R/U/D semantics (Create/Read/Update/Delete semantics), or other hypertext transfer protocol ("HTTP")-based or file-transfer protocol ("FTP")-based protocols (e.g., Simple Object Access Protocol). Additionally, communications may be performed by a wired system and/or wirelessly such as by satellite or wireless networks.

In conjunction with creating secondary copies in cloud storage sites 506A-N, the secondary storage computing device 504 may also perform local content indexing and/or local object-level, sub-object-level or block-level deduplication when performing storage operations involving various cloud storage sites 506A-N. Cloud storage sites 506A-N may further record and maintain, EM logs, store repair and maintenance data, store operational data, and/or provide outputs from determinative algorithms that are located in cloud storage sites 506A-N. In a non-limiting example, this type of network may be utilized as a platform to store, backup, analyze, import, preform extract, transform and load ("ETL") processes, mathematically process, apply machine learning models, and augment EM measurement data sets.

Current technology does not include the systems and methods for a fluid sampling and analysis system 100 (e.g., referring to FIG. 1) discussed above. Specifically, current technology does not allow for the measurement of UAOP, ARFO, and BP in situ under downhole conditions. Since the proposed system and methods take measurements at the source, the process enables the representative determination of AOP as opposed to the current practice of recombination of samples and recreation of reservoir conditions in laboratory.

The preceding description provides various embodiments of the systems and methods of use disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system. It should be understood that the compositions and methods are described in terms of "including," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, and may be modified and practiced in different but equivalent manners apparent to those skilled in the art having the benefit of the teachings herein. Although individual embodiments are discussed, the disclosure covers all combinations of all of the embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of those embodiments. If there is any conflict in the usages of a word or term in this specification and one or more patent(s) or other documents that may be incorporated herein by reference, the definitions that are consistent with this specification should be adopted.

What is claimed is:

1. A method, comprising:

lowering a downhole tool to a target depth of a wellbore;

sampling reservoir fluid containing asphaltene at the target depth using the downhole tool;

controlling a pressure of the sampled reservoir fluid while downhole to induce one or more phase transitions of the asphaltene;

measuring the sampled reservoir fluid after inducing the one or more phase transitions, wherein the phase transition comprises one or more kinetic phase transitions; and identifying fluid composition of the reservoir fluid based on the measuring.

2. The method of claim 1, wherein an information handling system communicatively coupled directly to the downhole tool is used to identify the fluid composition by performing an asphaltene analysis while the downhole tool is disposed in the wellbore.

3. The method of claim 1, wherein the downhole tool is a wireline formation testing tool, a measurement while drilling tool, or a logging while drilling tool.

4. The method of claim 1, wherein the controlling of the pressure is performed using a bidirectional pump connected to one or more sample chambers within a probe section of the downhole tool.

5. The method of claim 1, wherein the phase transition comprises (i) Precipitation and Flocculation, and (ii) Disassociation and/or Deposition.

6. The method of claim 1, wherein the measuring comprises measuring a fluid density of the sampled reservoir fluid.

7. The method of claim 1, wherein the measuring comprises measuring a soluble reservoir fluid composition using one or more optical measurement tools.

8. The method of claim 1, wherein the identifying at least part of the fluid composition comprises determining a type and/or concentration of asphaltene, saturates, aromatics, resins, and C1-C5 compounds.

9. The method of claim 1, further comprising: performing a gravimetric test based on measurements of at least two separate pressure gauges; and compressing one or more probe channels back to a reservoir flowing pressure.

10. The method of claim 1, further comprising estimating an upper asphaltene onset pressure, asphaltene resin flocculation onset, and/or boiling point of the reservoir fluid based on at least one in situ measurement.

11. The method of claim 1, wherein the identifying involves at least one analysis technique selected from the group consisting of Colloidal Instability Index, Refractive Index, rate of precipitation of asphaltene, and any combination thereof.

12. The method of claim 1, wherein the controlling of the pressure comprises lowering the pressure of the sampled reservoir fluid at least 1,000 psi below hydrostatic pressure.

13. The method of claim 1, wherein for a given reservoir sample, the measuring is performed on a single sample of the reservoir fluid directly and without needing to mix multiple reservoir samples.

14. The method of claim 1, further comprising moving the downhole tool to multiple depths in the wellbore and identifying the fluid composition at each depth.

15. A method, comprising:

lowering a downhole tool to a target depth of a wellbore;

sampling reservoir fluid containing asphaltene at the target depth using the downhole tool, wherein the sampling comprises:

extracting a reservoir fluid from a reservoir through at least a focus sampling probe section, drawing in the reservoir fluid through at least a probe channel, and sealing the drawn reservoir fluid within a vacuum chamber connected to a bidirectional piston pump;

controlling a pressure of the sampled reservoir fluid while downhole to induce one or more phase transitions of the asphaltene;

measuring the sampled reservoir fluid after inducing the one or more phase transitions; and identifying fluid composition of the reservoir fluid based on the measuring.

* * * * *